US006261067B1

(12) United States Patent
Popov

(10) Patent No.: US 6,261,067 B1
(45) Date of Patent: Jul. 17, 2001

(54) LIQUID-GAS JET APPARATUS HAVING A PREDETERMINED RATIO FOR A CROSS-SECTION OF AN ACTIVE LIQUID NOZZLE AND A MIXING CHAMBER

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/202,775

(22) PCT Filed: Apr. 20, 1998

(86) PCT No.: PCT/RU98/00114

§ 371 Date: Dec. 21, 1998

§ 102(e) Date: Dec. 21, 1998

(87) PCT Pub. No.: WO98/50703

PCT Pub. Date: Nov. 12, 1998

(30) Foreign Application Priority Data

Apr. 21, 1997 (RU) ..... 97106391

(51) Int. Cl.[7] ..... F04F 5/44
(52) U.S. Cl. ..... 417/198; 417/196; 417/183
(58) Field of Search ..... 417/198, 186, 417/196, 151, 183

(56) References Cited

U.S. PATENT DOCUMENTS

| | | | | |
|---|---|---|---|---|
| 2,582,069 | | 1/1952 | Rose . | |
| 2,632,597 | | 3/1953 | Boeckeler . | |
| 4,084,855 | * | 4/1978 | Miles et al. | 299/64 |
| 4,396,356 | * | 8/1983 | Thompson | 417/186 |
| 4,534,862 | * | 8/1985 | Zlokarnik | 210/221.2 |
| 4,775,241 | * | 10/1988 | Stuckey | 366/142 |
| 5,993,167 | * | 11/1999 | Mochizuki | 417/174 |

FOREIGN PATENT DOCUMENTS

| | | |
|---|---|---|
| 2016262 | 7/1994 | (RU) . |
| 767405 | 9/1980 | (SU) . |
| 985462 | 12/1982 | (SU) . |
| 1755714 | 8/1992 | (SU) . |

OTHER PUBLICATIONS

Shumski K.P., "Vacuum Apparatuses and Devices" book, 1963, USSR, Moscow, "Mashigiz" Publishing House, pp. 476–477.

Sokolov E.Y., "Jet Apparatuses" book, 1970, USSR, Moscow, "Energy" Publishing house, p. 209.

* cited by examiner

*Primary Examiner*—Cheryl J. Tyler
(74) *Attorney, Agent, or Firm*—Mark A. Oathout

(57) ABSTRACT

The invention relates to the field of jet technology. The surface area of the minimal cross-section of the mixing chamber represents from about 1.1 to about 7.98 times that of the minimal cross-section of the active liquid nozzle. A liquid-gas jet apparatus with the above described correlation of sizes has a higher efficiency due to reduced energy losses.

2 Claims, 1 Drawing Sheet

LIQUID-GAS JET APPARATUS HAVING A PREDETERMINED RATIO FOR A CROSS-SECTION OF AN ACTIVE LIQUID NOZZLE AND A MIXING CHAMBER

This application claims priority of international application number PCT/RU98/00114 with an international firing date of Apr. 20, 1998, now abandoned.

BACKGROUND OF THE INVENTION

This invention relates to the field of jet technology, primarily to liquid-gas jet apparatuses for evacuation or creation of a vacuum.

Liquid-gas jet apparatuses, comprising an active nozzle, a receiving chamber, a mixing chamber, a diffuser and ducts for supply of active and passive mediums, are known (see book of K. P. Shoumskoy "Vacuum apparatuses and devices", M., Mashgiz, 1963, pages 476–477).

However, these jet apparatuses have a relatively low efficiency factor, which limits their application range.

The starting point of this invention is a liquid-gas jet apparatus comprising an active nozzle and a mixing chamber with a diffuser. Optimal relative sizes of the mixing chamber and the active nozzle of this apparatus are determined by a formula depending on the ratio between the pressure differential of mediums' mixture and pressure differential of active liquid medium (see book of Sokolov[a] E. Y. and others, "Jet apparatuses", M., Energy, 1970, page 209).

However, operation of these jet apparatuses is accompanied by significant energy losses during the mediums' mixing process, which accounts for low efficiency of these devices.

SUMMARY OF THE INVENTION

The technical problem to be solved by this invention is an increase of efficiency of a liquid-gas jet apparatus by optimization of the mixing process for gaseous and liquid mediums in a flow-through channel of the jet apparatus.

The mentioned problem is solved as follows: a liquid-gas jet apparatus comprising an active nozzle and a mixing chamber has the surface area of the minimal cross-section of the mixing chamber representing from about 1.1 to about 7.98 times that of the surface area of the minimal cross-section of the active liquid nozzle.

Research has shown, that the mode of mixing of an active (ejecting) liquid and a passive (evacuated) gas significantly affects the efficiency factor of the liquid-gas jet apparatus because the biggest losses, especially hit losses, take place just at the moment of the first contact of the highly dynamic liquid medium and evacuated gaseous medium. That is why correlation of sizes of the minimal cross-section (as a rule an outlet cross-section) of the active nozzle and the minimal cross-section of the mixing chamber is one of the main factors affecting effectiveness of the jet apparatus. The above mentioned correlation of sizes of the mixing chamber and active nozzle of the vacuum-producing liquid-gas jet apparatus provides conditions, in which the liquid flow is finely dispersed in the mixing chamber after passing through the active nozzle and blocks the flow area of the mixing chamber. This prevents reverse flow from the jet apparatus outlet and the forming of eddy zones along the walls of the entrance section of the mixing chamber. All of which results in a higher efficiency of the jet apparatus due to reduction of hydraulic resistance and consequently the reduction of energy losses.

DETAILED DESCRIPTION

Figure 1:
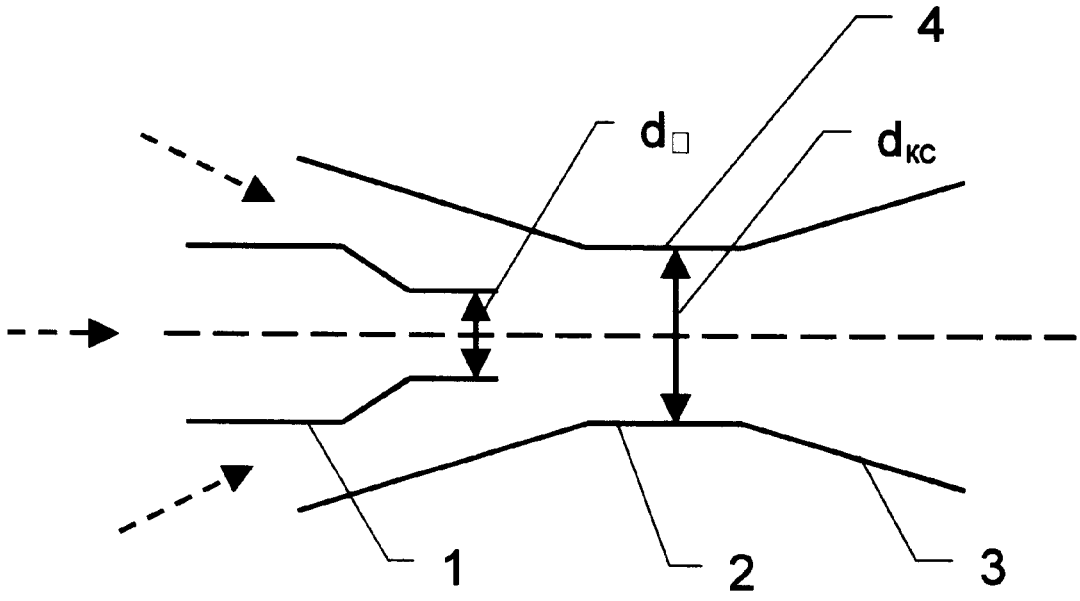
FIG. 1 shows a schematic diagram of one embodiment of the described liquid-gas jet apparatus.

The liquid-gas jet apparatus comprises an active liquid nozzle 1, a mixing chamber 2 and a diffuser 3. The surface area of the minimal cross-section (having diameter $d_{kc}$) of the mixing chamber 2 represents from about 1.1 to about 7.98 times that of the minimal cross-section (having diameter $d_{\square}$) of the active liquid nozzle 1, i.e. $f=(d_{kc}/d_{\square})^2$=about 1.1 to about 7.98. Stated alternatively, the cross-sectional area of the mixing chamber 2 is about 1.1 to about 7.98 times larger than the cross-sectional area of the active liquid nozzle 1. In case of a multi-channel active liquid nozzle 1 (not shown in the diagram) the surface area of the minimal cross-section of the active liquid nozzle is total surface area of the minimal cross-sections of all nozzle's channels.

The liquid-gas jet apparatus works as follows:

An active liquid medium, flowing from the nozzle 1, entrains a passive gaseous medium into the mixing chamber 2. Then the mediums' mixture formed in the mixing chamber 2 passes to the diffuser 3, where kinetic energy of the mediums' mixture is partly transformed into potential energy of pressure.

INDUSTRIAL APPLICABILITY

The proposed jet apparatus, besides being applicable to the petrochemical industry, can be also applied in other industries, where evacuaton or compression of a gaseous medium by means of liquid medium's kinetic energy are required.

What is claimed is:

1. A liquid-gas jet apparatus, comprising an active liquid nozzle and a mixing chamber, wherein a ratio of the surface area of the minimal cross-section of the mixing chamber to the surface area of the minimal cross-section of the active liquid nozzle is within the range of about 1.1 to about 7.98.

2. A method for increasing the efficiency of a liquid-gas jet apparatus, having an active liquid nozzle and a mixing chamber, for evacuating a gaseous medium by kinetic energy of a liquid medium, comprising:

making the liquid-gas jet apparatus wherein a ratio of the surface area of the minimal cross-section of the mixing chamber to the surface area of the minimal cross-section of the active liquid nozzle is within the range of about 1.1 to about 7.98.

* * * * *